United States Patent [19]

Quinlan

[11] 4,108,692

[45] Aug. 22, 1978

[54] ROCK BIT ROLLER CUTTER AND METHOD THEREFOR

[75] Inventor: John R. Quinlan, Buena Park, Calif.

[73] Assignee: Smith International, Inc., Newport Beach, Calif.

[21] Appl. No.: 751,025

[22] Filed: Dec. 16, 1976

Related U.S. Application Data

[63] Continuation of Ser. No. 540,440, Jan. 13, 1975, abandoned.

[51] Int. Cl.[2] ..... C21D 9/22

[52] U.S. Cl. ..... 148/12.3; 148/13.2; 148/14; 148/31; 148/32.5; 148/142; 175/374; 175/409

[58] Field of Search ..... 175/372, 374, 409; 148/12.3, 31, 32.5, 13.2, 142, 14

[56] References Cited

U.S. PATENT DOCUMENTS

| | | | |
|---|---|---|---|
| 2,489,529 | 11/1949 | Grange | 148/13.2 |
| 2,626,128 | 1/1953 | Boice | 175/374 |
| 2,687,875 | 8/1954 | Morlan et al. | 175/374 |
| 2,870,051 | 1/1959 | Klement | 148/32.5 |
| 2,944,889 | 7/1960 | Klement | 75/162 |
| 3,093,518 | 6/1963 | Bieber | 148/31 |
| 3,093,519 | 6/1963 | Decker et al. | 148/31 |
| 3,842,921 | 10/1974 | Dill et al. | 175/374 |

OTHER PUBLICATIONS

Mining Congress Journal, Apr. 1971, pp. 40–48.
Alloy Digest, "Unimar 250," SA-304, May 1974, Engr. Alloy Digest Inc., Upper Montclair, N.J.

*Primary Examiner*—W. Stallard

[57] ABSTRACT

In a rock bit, roller cutter body having plural hard metal inserts; the body is formed of an age-hardenable superalloy having dimensional stability through hardening enabling pre-drilling of the insert-receiving holes prior to hardening the body, and method therefor.

6 Claims, 2 Drawing Figures

ROCK BIT ROLLER CUTTER AND METHOD THEREFOR

This is a continuation of application Ser. No. 540,440, filed Jan. 13, 1975, and now abandoned.

BACKGROUND OF THE INVENTION

This invention has to do with rock bits of the type used for drilling into the earth, and more particularly, is concerned with improvements in the roller cutter components of well drilling bits.

Rock bits of the rotary type generally comprise a body having one or more downwardly extending legs, each of which is provided with a downwardly and inwardly extending journal on which a roller cutter is mounted for rotation under the force of engagement of the weighted bit body and the face of the formation being drilled. For purposes of fracturing and gouging the formation face, the roller cutters, which may be cylindrical in configuration, are provided with a peripherally distributed series of relatively harder tooth-like cutting elements, usually referred to as hard metal inserts. The hard metal inserts may be fabricated of tungsten carbide or similar hard wearing material.

In well drilling the bit body is rotated about the well axis and the body carried roller cutters rotate on their own axis disposed angularly relative to the well axis. As the roller cutters rotate successive ones of the mentioned hard metal inserts bear against the formation and penetrate and fracture the formation face for removal by drilling mud as drilling proceeds. Drilling continues in this manner until the bit, i.e. its roller cutters, are too warn to continue effectively. At this point the drill string must be pulled and a new bit attached and the string relowered to the hole bottom. The downtime required for changing the bit and the labor involved are such that fewer needed bit changes are highly desired.

PRIOR ART

The roller cutters or bit bodies wear in a variety of ways. The tooth-like cutting elements may be abraded to dullness over time as a function of the hardness and toughness of these hard metal inserts. Additionally, however, the cutting elements or inserts may be dislodged from the supporting roller and this is a function in large measure of the hardness of the roller body into which the hard metal inserts or cutting elements are fitted.

Increasing the hardness of the roller body has heretofore been constrained by practical production considerations. Employing conventional steels, hardened by quenching, the hardness can be progressively increased by known metallurgical procedures. Such increases are not desirable, however, beyond a point because subsequent to hardening the roller bodies must be precisely drilled to snugly receive the hard metal inserts. Too hard roller bodies are only difficultly and slowly drilled, increasing time problems and thus costs of production. Predrilling of the roller bodies, prior to hardening, is not a viable alternative since the quench hardening so alters the dimensions of the insert-receiving holes as to render them largely useless for insert reception or retention.

It is with the amelioration of rock bit production problems and the substantial elimination of the loss of hard metal inserts, that the present invention is especially concerned. Accordingly it is a major objective of the invention to prolong the operational life of rock bits having roller cutters, by improving the retention of hard metal cutting elements in the roller body. A further objective is to provide a rock bit roller cutter body of a composition to be harder than such bodies heretofore used, for maximum hard metal insert retention, but nonetheless readily usable in rock bit production with substantial assembly economies, by virtue of exceptional dimensional stability in hardening operations, enabling the preforming of insert receiving holes in relatively soft metal and their maintenance of size after hardening.

Accordingly these and other objectives of the invention are met by the method, in the manufacture of rock bit roller cutters comprising a roller body having plural peripherally distributed holes, and hard metal inserts press-fitted into the holes in outwardly projecting relation, which includes the steps of forming the roller body of an age-hardenable steel, forming the body holes therein and hardening the roller body to a hardness of not less than 50 $R_c$. The insert-receiving holes thus are formed to their final dimension in the roller body prior to hardening. In certain embodiments the method includes press-fitting the inserts into the holes therefor subsequent to hardening the roller body, while in other embodiments the hard metal inserts may be press-fitted into the holes therefor prior to hardening the roller body, so that the roller body is hardened with the inserts in place therein.

Typically roller body hardening is effected at temperatures between 900° and 1000° F for not less than 2 hours and preferably at about 950° F for about 3 hours.

In preferred embodiments, the present method for the manufacture of rock bits having roller cutters includes forming a roller body of age-hardenable nickel or cobalt superalloy, drilling this roller body to provide therein a plurality of insert receiving holes adapted to snugly interfit cylindrical hard metal inserts in outward projecting relation and hardening the roller body so drilled to a hardness not less than 50 $R_c$, under conditions including the times and temperatures mentioned above, and cooling without quenching, which do not reduce the drilled dimension of the holes, and thereafter press-fitting hard metal inserts, e.g. tungsten carbide inserts, into the roller body.

The nickel-cobalt superalloy compositions preferred for use herein have percentage compositions set out hereinafter, but it may be noted here, that the nickel and cobalt components of these alloys constitute the largest metal concentration in the alloys, other than iron present.

As noted above, the roller bodies with which the invention is concerned are journaled on the bit legs. For this purpose the rollers may advantageously be provided with a journal bearing surface comprising aluminum bronze heat treated to have a continuous phase of a first and relatively lower degree of hardness e.g. between 25 and 30 $R_c$ and a discontinuous particulate phase of a second and relatively higher hardness, e.g. between 40 and 45 $R_c$.

The invention further provides a rock bit roller cutter produced in accordance with the above method, and more particularly in a rock bit structure, a rock bit roller cutter body having a peripherally distributed series of hard metal inserts e.g. tungsten carbide, press-fitted into holes therein in outward projecting relation, the body comprising an age-hardened nickel-cobalt superalloy.

Additionally the invention contemplates a rock bit roller cutter body structure comprising a body consisting of an age-hardenable superalloy, the body being distributively drilled on its outer periphery for plural hard metal insert receptions. The mentioned body is typically age-hardened, combined with hard metal e.g. tungsten carbide inserts, and may be further provided with the mentioned aluminum bronze bearing structure which has been heat treated to have the continuous phase of relatively lower degree of hardness and the discontinuous phase of a relatively higher hardness.

BRIEF DESCRIPTION OF THE DRAWINGS

The invention will be further described as to an illustrative embodiment in conjunction with the attached drawing in which.

DESCRIPTION OF THE PREFERRED EMBODIMENTS

Figure 1:
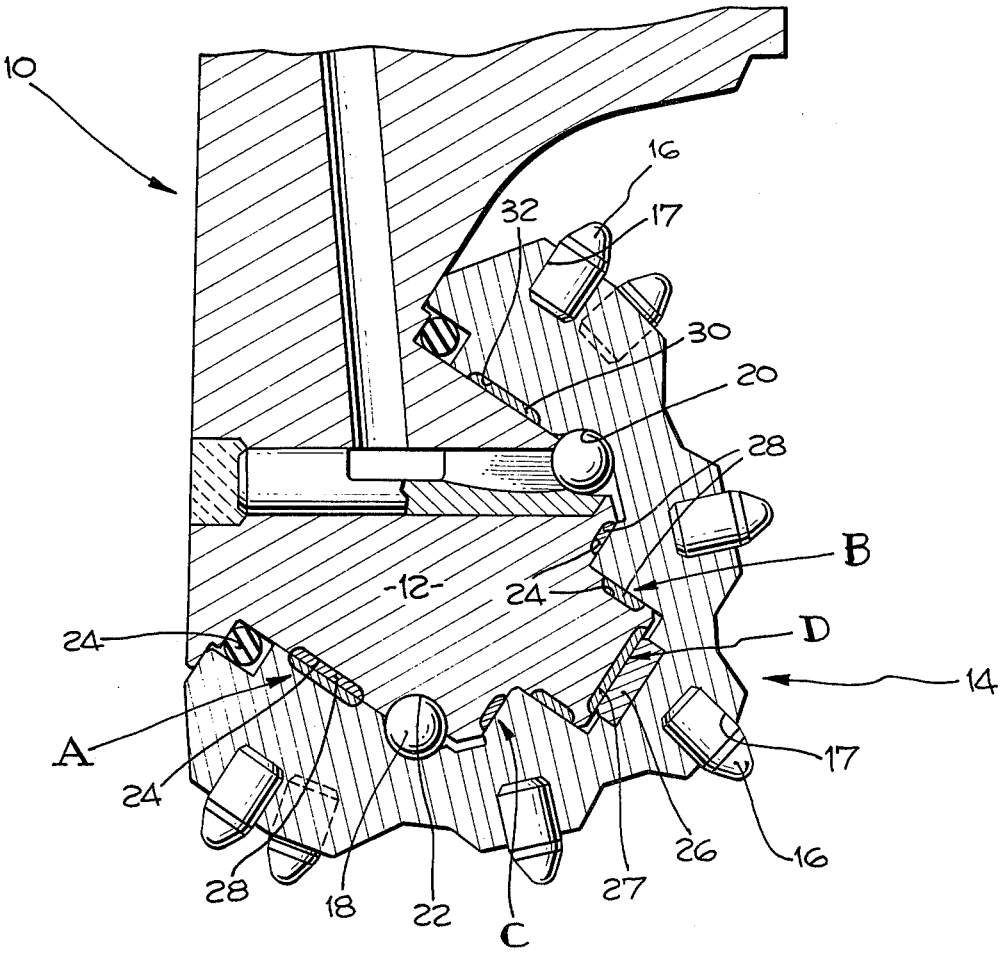
FIG. 1 is a view in section of a rock bit roller cutter according to the invention.
Figure 2:
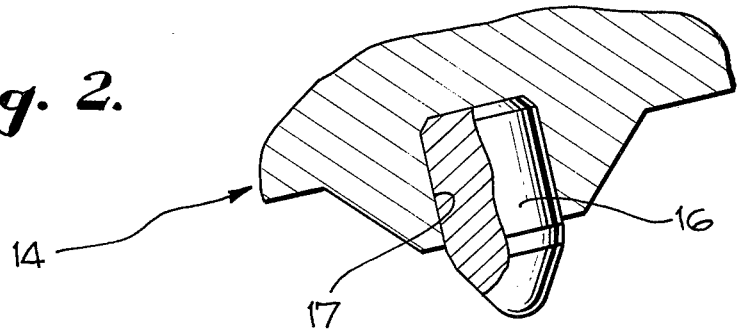
FIG. 2 is a fragmentary, enlarged, generally sectional view of a hole-received hard metal insert and surrounding roller body.

With reference now to the drawings in detail in FIG. 1 there is shown a rotary rock drill bit 10 having a diagonally downwardly extending journal portion 12 upon which a rotary cutter body 14 is adapted to rotate, the cutter body having outwardly projecting therefrom hard metal e.g. tungsten carbide inserts 16 in close fitting holes 17. See FIG. 2. Ball bearings 18 ride in ball race 20 in the bit journal 12 and complementary race 22 in the cutter body 14. As shown, lubricant is fed to the ball bearings 18 and other bearing surfaces, to be described, between the roller cutter body 14 and the journal 12. Escape of lubricant from the bearing area within the roller body 14 and the prevention of the entry of cuttings and other foreign materials from the outside is sealed off by a suitable seal, such as O-ring 24.

In addition to ball bearings 18 the rock bit 10 is provided with other bearings means at the area A and at the reduced end area B, these bearing means lying about the journal 12. Further, bearing means or surfaces are provided to take care of thrust at areas such as C and D. Conventionally at A roller bearings are provided. At areas B, C, and D, it is known to provide bearing material in the form of inserts or deposits in the form of weld metal overlays. Thusfar described, the rock bit is generally conventional, with the configuration of the roller body, the hard metal inserts and the size and location of the bearing areas all variable within the scope of the present invention.

The invention in a first important aspect is particularly related to the roller body 14 and its facile manufacture with the hard metal inserts 16 securely retained therein.

For this purpose, the invention provides for the fabrication of the roller body from a superalloy composition comprising predominantly iron, nickel, and cobalt, with iron constituting not less than 50% by weight of the composition and nickel and cobalt being the second and third largest single constituent. It is characteristic of the alloys hereof, which are known as "maraging steels" that they age-harden i.e. they are not quench-hardened unlike the quenched and tempered medium carbon alloy steels, heretofore known for use in rock bit fabrication. Moreover it is further characteristic of the alloys of interest herein that they are through-hardenable to Rockwell values of $50R_c$–$55R_c$ which is higher than hardness values usually associated with the mentioned previously used steel alloys. This hardness level has been found to provide superior support for hard metal cutting elements inset in the roller body made with age-hardening superalloys and thus to reduce substantially bit failure through cocking or ejection of cutting elements, and to thereby prolong effective bit life.

In practice the superalloy is forged to roller cutter rough shape, annealed, and machined to desired bearing and profile characteristics. Thereupon, and in a significant departure from previous practice, the roller cutter body is drilled, while yet soft metal i.e. not hardened, to define to precise dimension in the body the peripherally distributed series of insert-receiving holes. Then the hold body is age hardened by heating to between about 900° and 1000° F, preferably about 950° F, or somewhat higher or lower for particular alloy systems found at the extremes of the composition ranges given below, and for about three hours or until the desired level of hardness, i.e. not less than 50 $R_c$, is realized. The previously drilled holes remain at their drilled dimension; the hard metal inserts are, therefore, readily pressed into place in the manner of conventional cutter body insert emplacement. Thereupon the cutter body is finished e.g. by grinding in the bearing race 22. While a variety of superalloys may be employed within the major compositional criteria set out above, it is preferred to employ the 18 or 25% nickel-cobalt alloys. Thus there may be employed an alloy having the approximate composition, in weight percent of:

| | |
|---|---|
| Ni | 15 to 25% |
| Co | 6 to 10% |
| Mo | 4 to 6% |
| Ti | 0.2 to 0.6% |
| Al | 0.03 to 0.20% |
| C | 0.01 to 0.05% |
| Fe | The balance to 100% |

It is more particularly preferred to employ the lower percent level of nickel i.e. a composition having the composition in weight percent of:

| | |
|---|---|
| Ni | 17 to 19% |
| Co | 7 to 8.5% |
| Mo | 4.6 to 5.2% |
| Ti | 0.3 to 0.5% |
| Al | 0.05 to 0.15% |
| C | 0.3% |
| Fe | the balance to 100% |

Yield values for these and like suitable nickel-cobalt superalloys typically range between 250,000and 280,000 pounds per square inch.

It may be further observed that the hard metal inserts may be inserted in such alloys after drilling the holes and before hardening the roller cutter body, with like practical benefits in assembly time and drilling life.

A second important aspect of the invention is the combination of the just mentioned alloy roller cutter bodies with the superior two-phase aluminum bronze bearing material referred to briefly above. While two-phase aluminum bronze materials have been taught to be applicable to conventional metal roller cutter bodies in the like assigned copending application of John R. Quinlan, Ser. No. 418,310, filed Nov. 23, 1973, and the disclosure of that application is incorporated by reference herein, it has not been taught to employ this highly advantageous bearing material in a superalloy roller cutter body environment. Accordingly, and with further reference to FIG. 1, the bearing areas A, B, C and D, in the roller body 14 are provided with shallow grooves 24. A similar operation is generally performed on the opposed face portions of the journal 12 or other part upon which the body 14 is adapted to rotate. A thrust button 26 lies between the inner end of the roller body 14 and against disc 27 in the end of the leg journal.

In making a bearing, and processing the material thereof, it is preferred to provide a groove or grooves 32 in one of the relatively movable elements, such as the body 14 in areas A, B, c and D as shown, and in these grooves to deposit a weld overlay of aluminum bronze 28 which is treated by annealing at 1500° F.

When treated by this procedure, the microstructure of the aluminum bronze is drastically altered. Untreated aluminum bronze is quite fine and the particle shape is generally very uniform. After the described treatment, the microstructure is quite different. There are relatively small rounded particles which are of quite different shape and of larger size than the particles of the untreated material. There are considerably larger particles also, most of which have elongated shapes, and those elongated particles are much broader or wider than the elongated particles of the untreated material. In general, the treated aluminum bronze comprises considerably larger particles which are much more widely spaced than the very small closed spaced particles of the untreated material. Alternatively, the aluminum bronze material 28 may be applied to the grooves 24 in the roller body 14 by means of the tungsten inert gas process as more fully described in the Quinlan application above noted.

The aluminum bronze material described may be obtained under the trademark "Ampotrode 300." It consists of 80% copper, 15% aluminum and 5% iron. Other aluminum bronzes can be used, e.g. having, before heat treating, a uniform hardness of 39$R_c$ and, after heat treating, dispersed phase particles of a hardness of 46$R_c$; the matrix phase through which they are dispersed having a hardness of 27 $R_c$.

The aluminum bronze bearing material and bearing described has very high wearing qualities and provides a good, smooth bearing surface, which of course must be adequately lubricated. When used with the hard metal overlay 30 in groove 32 in the opposite relatively movable member journal 12, it provides bearing materials of different degrees of hardness (i.e. the hard metal may have a hardness of 52 $R_c$ to 63 $R_c$) which is a desirable quality in bearings, although it has frequently been considered necessary in drilling oil wells that the shock and heat to which the bearings are subjected require that both bearing materials be of hard metal. However, with the heat treated aluminum bronze 28 working with a hard metal overlay 30 in the other relatively movable part, a highly desirable bearing action exists. While there is a difference in hardness of the hard metal overlay and the heat treated aluminum bronze overlay, the hardened particles found to be produced by heat treating aluminum bronze, are sufficiently hard to withstand the heavy work to which bearings in rock bits are subjected. With the improved life of rock bits on their working surfaces, due to the inserts of tungsten carbide, and particularly those supported by superalloy roller bodies, the failure point in bits of this type generally has been the bearings. With the aluminum bronze bearing combined with the superalloy roller body, the life expectancy of rock bits can be extended to a considerable degree.

I claim:

1. In the manufacture of rock bit roller cutters to be mounted on friction journals, wherein a cutter comprises a roller body having pural peripherally distributed holes, and hard metal inserts press-fitted into said holes in outwardly projecting relation, the steps of forming the roller body of a maraging steel comprising a nickel-cobalt alloy, forming said body holes therein, then age-hardening the roller body to a hardness of not less than 50 $R_c$ under conditions maintaining dimensions of the formed holes and thereafter press-fitting hard metal inserts into said roller body holes.

2. The method according to claim 1 in which said insert-receiving holes are formed to their final dimension in the roller body prior to hardening.

3. The method according to claim 1 including also press-fitting said inserts in the holes therefor prior to hardening the roller body so that the body is hardened with the inserts in place therein.

4. The method according to claim 1 including also providing a bearing surface on said roller body comprising aluminum bronze heat treated to have a continuous phase of a first and relatively lower degree of hardness between 25 and 30 $R_c$ and a particulate discontinuance phase of a second and relatively higher degree of hardness between 40 and 45 $R_c$, the lower degree of hardness being less and the higher degree of hardness being greater than that of a friction journal upon which the roller body is to be mounted.

5. The method according to claim 1 including effecting hardening of the roller body by heating at 950° F for about 3 hours and cooling without quenching.

6. In a rock bit structure, a rock bit roller cutter body having a peripherally distributed series of hard metal inserts press-fitted into holes therein in outwardly projecting relation, said roller body comprising an age-hardened nickel-cobalt alloy selected from the group consisting of the alloy which consists essentially in percent by weight of

| | |
|---|---|
| Ni | 17 to 19% |
| Co | 7 to 8.5% |
| Mo | 4.6 to 5.2% |
| Ti | 0.3 to 0.5% |
| Al | 0.05 to 0.15% |
| C | 0.03% |
| Fe | the balance to 100%, |

and the alloy which consists essentially in percent by weight of

| | |
|---|---|
| Ni | 17 to 19% |
| Co | 7 to 8.5% |
| Mo | 4.6 to 5.2% |
| Ti | 0.3 to 0.5% |
| Al | 0.05 to 0.15% |
| C | 0.03% |
| Fe | the balance to 100% |

* * * * *